United States Patent [19]

Tholander

[11] Patent Number: 4,796,675

[45] Date of Patent: Jan. 10, 1989

[54] YARN STORING, FEEDING AND MEASURING DEVICE

[75] Inventor: Lars H. G. Tholander, Huskvarna, Sweden

[73] Assignee: Aktiebolaget IRO, Ulricehamn, Sweden

[21] Appl. No.: 147,649

[22] Filed: Jan. 25, 1988

Related U.S. Application Data

[60] Continuation of Ser. No. 889,646, Jul. 24, 1986, abandoned, which is a division of Ser. No. 614,774, filed as PCT EP83/00254 on Sep. 30, 1983, published as WO84/01394 on Apr. 12, 1984, Pat. No. 4,627,474.

[30] Foreign Application Priority Data

| | | | |
|---|---|---|---|
| Sep. 30, 1982 | [SE] | Sweden | 8205598 |
| Dec. 10, 1982 | [SE] | Sweden | 8207096 |
| Sep. 13, 1983 | [SE] | Sweden | 8304891 |
| Sep. 20, 1983 | [SE] | Sweden | 8305040 |

[51] Int. Cl.[4] ..... D03D 47/36; R65H 51/20

[52] U.S. Cl. ..... 139/452; 242/47.01

[58] Field of Search ..... 139/452; 242/47.01, 242/47.12, 47.13, 36, 49, 22; 66/125 R, 132 R; 112/253, 279; 57/353, 58.76, 83, 87, 81

[56] References Cited

U.S. PATENT DOCUMENTS

| | | | |
|---|---|---|---|
| 1,308,529 | 7/1919 | Peterson | 242/22 |
| 2,731,786 | 1/1956 | Klein | 57/58.76 |
| 2,785,526 | 3/1957 | Keith | 57/58.76 |
| 2,912,945 | 11/1959 | Nowicki | 66/132 R |
| 3,177,643 | 4/1965 | DeHalleux et al. | 57/58.76 |
| 3,410,071 | 11/1968 | Heimes | 57/58.76 |
| 3,455,341 | 7/1969 | Pfarrwaller et al. | 139/452 |
| 3,501,905 | 3/1970 | Landwehrkamp et al. | 57/87 |
| 3,890,809 | 6/1975 | Tenconi | 66/132 R |
| 4,226,379 | 10/1980 | Brouwer et al. | 139/452 |
| 4,378,821 | 4/1983 | Umezawa | 139/452 |
| 4,407,336 | 10/1983 | Steiner | 242/47.01 |
| 4,444,226 | 4/1984 | Ichikawa et al. | 242/70.01 |

*Primary Examiner*—Philip R. Coe
*Assistant Examiner*—Joseph S. Machuga
*Attorney, Agent, or Firm*—Flynn, Thiel, Boutell & Tanis

[57] ABSTRACT

A yarn storing and feeding device having a stationary storage drum onto which an intermediate yarn store is wound by a winding-on device, and from which the yarn is withdrawn through a gap around the withdrawal end of the storage drum. At least one yarn stopping device is associated with the gap for controlling the withdrawal of yarn. The stopping device includes a stopping element arranged radially inwardly with respect to the gap, and movable radially outwardly to extend across the gap in response to a magnetic actuator located radially outwardly with respect to the gap.

13 Claims, 2 Drawing Sheets

1
2
3
4
5
6
7
8
10
11
12
13
14
15
16
17
18
F

YARN STORING, FEEDING AND MEASURING DEVICE

This application is a continuation of U.S. Ser. No. 889,646, filed July 24, 1986, and now abandoned, which was in turn a division of U.S. Ser. No. 614,774 filed May 17, 1984, and now U.S. Pat. No. 4,627,474, which was originally filed on Sept. 30, 1983, as PCT/EP83/00254.

The present invention relates a yarn storing, feeding and measuring device, particularly for jet looms, in accordance with the generic clause of claim 1.

DE-A No. 3123760 discloses a yarn storing, feeding and measuring device for jet looms having a stationary storage drum onto which an intermediate yarn store is wound by a winding-on device and from which the yarn is withdrawn spiralling through a gap around the withdrawal end of the storage drum.

This prior art yarn storing and feeding device comprises a yarn stopping device consisting of a yarn stopping element and an actuator means for actuating said yarn stopping element such that it can be moved into a gap or space located between the stopping device and the withdrawal end of the storage drum. The actuator means of this prior art yarn storing and feeding device is formed by an electromagnetic coil for actuating said stopping element having the form of a pin. When feeding an actuating current to said electromagnetic coil, the magnetic field of said coil urges the pin-like stopping member radially inwardly against the surface of the storage drum. In this position of the pin-like member forming the stopping element, a further withdrawal of the intermediate yarn store wound on the storage drum is prevented. In recent times, the design of yarn storing and feeding devices of the above-mentioned kind has become more and more complicated due to the fact that these devices are provided with a greater number of stopping devices for achieving a better adaption of the length of the weft yarn withdrawn from the storage drum during one shot of the weaving machine to the desired weft yarn length, while maintaining the compact design of the yarn storing and feeding device.

The present invention seeks to improve the device of the above mentioned type so as to give it a simpler, cost-saving and compact structure.

In accordance with the teaching of the present invention, only the actuator means of the stopping device is located radially outwardly with respect to the gap between the actuator means and the drum, while the stopping element is arranged radially inwardly with respect to this gap.

Such a design enables a very compact structure of the stopping device as the part of the stopping device located outwardly of the gap only comprises the actuator means preferably being an electromagnetic coil. Such a design results in a more reduced length of the stopping device in the axial direction of the yarn storing and feeding device when compared with the design of the prior art yarn storing and feeding device.

Preferably, the stopping element is movably disposed in a radial bore provided in a guiding portion located close to the withdrawal end of the storage drum. When feeding an actuating current to the electromagnetic coil located outside with respect to the gap, the stopping element located in the radial bore opposite to said electromagnetic coil is attracted by the magnetic force thereof so that it becomes moved into said gap.

When switching off the actuating current, a permanent magnet located at the inner end of the bore retracts the stopping element.

Preferably, the stopping element has a rounded edge or spherical form at its end directed to the gap.

A preferred embodiment of the present invention will be described hereinafter with reference to the attached drawings.

Figures 1, 2, 3, 4:
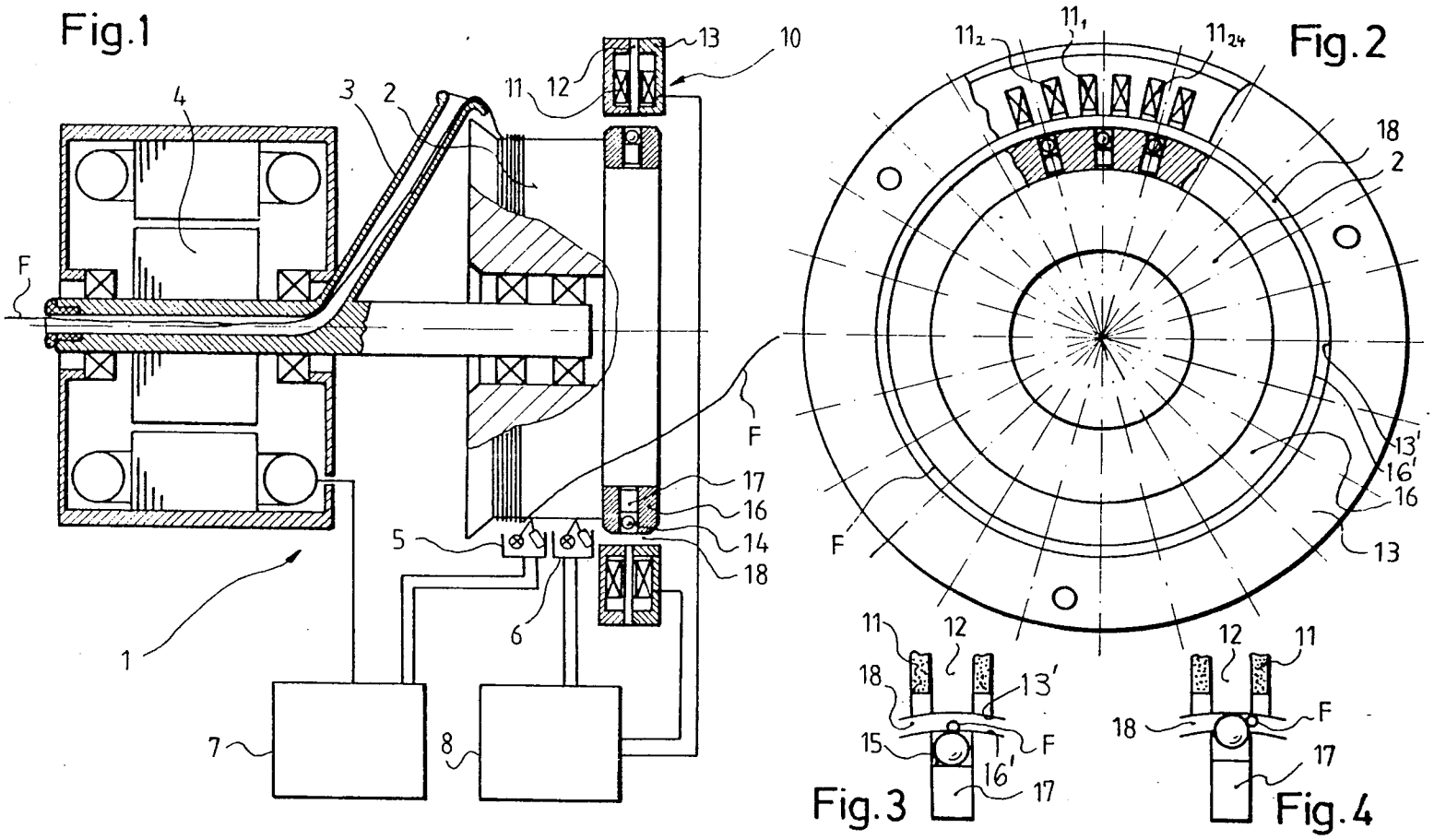
FIG. 1 shows a side view of a device in accordance with the present invention, partially in cross-sectional representation.
FIG. 2 shows a front view of the device as shown in FIG. 1.
FIGS. 3 and 4 show details of the device shown in FIGS. 1 and 2.

Referring now to FIG. 1, a feeding device (1) consists of a storage drum (2), a winding-on device (3) or orbiting feeder tube (3) and an electric motor (4). A yarn (F) being supplied to the orbiting feeder tube (3) driven by the electric motor (4) is wound onto the storage drum (2). This storage drum is a stationary storage drum being maintained in a stationary position with respect to its environment by a magnetic means (not shown here). Devices of this type are known per se in the art. For purposes of the present disclosure, it should be noted that this art is exemplified by U.S. Pat. No. 3,455,341 and by U.S. Pat. No. 4,226,379. The feeding device (1) is provided with a storage sensor (5) located close to the generally cylindrical surface of the storage drum (2). This storage sensor (5) can be a so-called maximum sensor preferably consisting of a light-emitting device and a light sensing device. This storage sensor (5) generates a signal indicating the amount of yarn stored on the drum, i.e. the number of turns of yarn wound onto the drum. Based on this signal, a storage control unit (7) controls the operation of the electric motor (4) in such a way that there is continuously a sufficient amount of yarn available on the yarn storage drum (2). Storage control units (7) are per se known in the art. For purposes of the present disclosure, it should be noted that this art is exemplified by DE-OS No. 2908743, FR-A No. 1562223 and No. PCT/EP83/00121 (assignee's own).

As shown in FIG. 1, there is disposed a yarn sensing means (6) at the withdrawal end of the storage drum arranged such that the yarn passes its detection area during withdrawal from the drum (2). This yarn sensing means preferably consists of a single yarn sensor (6) producing pulse signals, each pulse signal indicating that the yarn (F) passes a detection area of the yarn sensor (6). This sensor (6) could also be located in front of the withdrawal end of the storage drum, but has to be arranged such that the yarn passes its detection area during withdrawal from the storage drum (2). A yarn stopping device (10) located at the withdrawal end of the storage drum (2) consists of an actuator means (11) comprising a plurality of electromagnetic coils (11), a plurality of coil cores (12), each of the electromagnetic coils (11) being wound around a coil core (12) supported on a balloon limiting ring (13) consisting of two U-shaped rings covering said plurality of electromagnetic coils (11). Said balloon limiting ring (13) is fixedly secured to the environment of the feeding device (1), for example, to a base plate thereof. A ring-shaped guiding portion (16) is connected to the withdrawal end of the storage drum (2). Said guiding portion (16) supports a plurality of yarn stopping elements (14), each of said yarn stopping elements (14) consisting of a metal ball (14) movably disposed in a radial bore (15) provided in the guiding portion (16).

As shown in FIGS. 3 and 4, the respective electromagnetic coils (11) and associated cores (12) are arranged opposite to said bores (15). The continuous inner annular surface (13') on the balloon limiting ring (13), and the opposed outer annular surface (16') on the guiding portion (16) defined therebetween an annular gap (18) which is preferably in the order of 1–2 millimeters. The yarn (F) passes through said gap when being withdrawn from the storage drum. A permanent magnet (17) is located at one end of each bore (15) for moving said metal ball (14) back into said bore (15) after switching off an actuation current fed to the respective electromagnetic coils (11). As shown in FIGS. 3 and 4, ball (14) is attracted by the magnetic force of coil (11) when switching on the actuation current fed to coil (11) so as to abut the surface (13'). The width of the gap (18) corresponds to the radius of the metal ball (14). When the coil (11) is not activated, the permanent magnet (17) will attract the metal ball (14), so that the ball will be completely positioned inside the bore (15), so that the yarn (F) can be freely withdrawn in the axial direction from the storage drum (2).

The magnetic force of each electromagnetic coil (11) is chosen such that this force will overcome the attraction force of the permanent magnet (17) when feeding the actuation current to the coil (11). The metal ball (14) will thereby move outwardly in the radial direction of the bore (15) and come into contact with the free end of the coil core (12), as defined on the annular surface (13'). In this condition, approximately half of the metal ball blocks the gap (18) for the passage of the yarn (F) in such a way that the withdrawal of the yarn (F) from the storage drum (2) is terminated. When switching off the actuation current fed to the coil (11), the tension in the yarn (F) being pulled at the beginning of the weft yarn insertion reacts against the rounded surface of the ball (14) so as to impose a radially inwardly directed force component against the ball (14). The force component co-acts with the magnetic force of the permanent magnet (17) such that the metal ball (14) will return to its starting position so as to come into contact with the permanent magnet (17). Since the tension of the yarn co-acts with the magnetic force of the permanent magnet (17) due to the shape of the metal ball (14), the holding force of the permanent magnet (17) can be relatively low. Hence, only a small portion of the attracting force generated by the electromagnetic coil (11) is required for overcoming the magnetic force of the permanent magnet (17). For this reason the yarn stopping device (10) in accordance with the present invention works faster than prior art devices using stopping elements (14) which are needle-shaped or pin-shaped. For further enhancing the operation of the yarn stopping device (10), a thin plate of non-magnetic material can be positioned at the outer end of the permanent magnet (17) and/or on the free end of the coil core (12) for eliminating a magnetic sticking or "adhesion" between the metal ball (14) and the permanent magnet (17) and/or the coil core (12).

Figure 5:
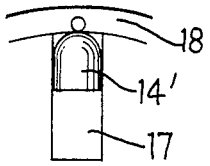
FIGS. 5 and 6 show an alternate embodiment.
Figure 6:
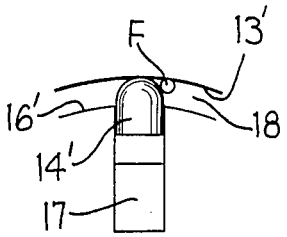

The stopping element (14') can also have the form of a short-cylindrical pin with a plain inner end directed to the permanent magnet (17) and a rounded, preferably semi-spherical outer end as shown by FIGS. 5 and 6 since this coacts and reacts in the same manner as the ball (14).

I claim:

1. A yarn storing and feeding device comprising a stationary storage drum onto which an intermediate yarn store is wound by a winding-on device and from which the yarn is withdrawn spiralling through a gap around the withdrawal end of the storage drum, the stationary storage drum being surrounded by a stationary ring structure adjacent the withdrawal end so as to define said gap therebetween, and at least one yarn stopping means cooperating with the gap for stopping the withdrawal of yarn, said yarn stopping means including:

(a) a yarn stopping element arranged radially inwardly with respect to said gap and being supported on said drum for movement radially thereof between a retracted position wherein the stopping element is disposed radially inwardly of the gap and an extended position wherein an outer end part of the stopping element projects radially outwardly of the drum so as to radially span across said gap to contact said stationary ring structure and stop the withdrawal of yarn, (b) electromagnetic actuator means for causing said stopping element to be moved radially outwardly into said extended position when said actuator means is energized, said electromagnetic actuator means being mounted on said ring structure radially outwardly with respect to said gap, (c) means mounted on said stationary drum for at least partially urging said stopping element in its retracted position and for normally holding said stopping element in the retracted position; and (d) said outer end part having a rounded yarn contact surface which is of a convex rounded configuration in the circumferential direction of the gap so that the tensioned yarn engages the contact surface when the stopping element is in said extended position and imposes thereon a force tending to move said stopping element back towards said retracted position.

2. A device according to claim 1, wherein the stationary drum has opening means formed therein and extending generally radially outwardly through the periphery thereof, said stopping element being disposed within said opening means for movement radially relative to said stationary drum, and said urging and holding means comprising a permanent magnet which is mounted on said drum radially inwardly of said stopping element for normally holding said stopping element in its retracted position.

3. A device according to claim 2, wherein the opening means in said stationary drum comprises a bore which projects radially inwardly from the periphery of said drum, said permanent magnet being mounted within said bore in radially inwardly spaced relationship from the periphery of the drum, said stopping element being disposed within the radially outer portion of said bore so as to be normally held against said permanent magnet.

4. A device according to claim 3, wherein said stopping element comprises a spherical ball.

5. A device according to claim 1, wherein said actuator means comprises an electromagnetic coil disposed in surrounding relationship to a coil core, said coil core being radially aligned with said stopping element so as to be engaged therewith when the stopping element is in its extended position due to energization of said electromagnetic coil.

6. A device according to claim 1, wherein said urging and holding means comprises a permanent magnet.

7. A device according to claim 6, wherein said stopping element comprises a ball.

8. A device according to claim 6, wherein said stopping element comprises a short cylindrical pin which is radially movably supported within a bore formed in the drum, and the outer end part of said stopping element comprising a rounded substantially semi-spherical outer end on said pin.

9. A device according to claim 6, wherein said rounded outer end is of a substantially semi-spherical configuration.

10. A device according to claim 9, wherein said contact surface on said stopping element, when in said extended position, abuts a continuous inner annular surface defined on said stationary ring structure, and said rounded yarn contact surface being substantially semi-cylindrical and generated on a radius which substantially corresponds to the radial width of the gap.

11. A device according to claim 10, wherein the stopping element comprises a ball.

12. A device according to claim 10, wherein the stopping element comprises a generally cylindrical pin having a rounded substantially semi-spherical outer end defining thereon said rounded contact surface.

13. A device according to claim 1, wherein a plurality of said stopping devices are arranged in angularly spaced relationship around said drum.

* * * * *